US010907572B2

(12) United States Patent
Pierro

(10) Patent No.: US 10,907,572 B2
(45) Date of Patent: Feb. 2, 2021

(54) INTERNAL COMBUSTION ENGINE COMPRISING A LIQUID COOLING CIRCUIT

(71) Applicant: FPT INDUSTRIAL S.P.A., Turin (IT)

(72) Inventor: Enzo Pierro, Venaria Reale (IT)

(73) Assignee: FPT INDUSTRIAL S.P.A., Turin (IT)

( * ) Notice: Subject to any disclaimer, the term of this patent is extended or adjusted under 35 U.S.C. 154(b) by 0 days.

(21) Appl. No.: 16/323,233

(22) PCT Filed: Aug. 24, 2017

(86) PCT No.: PCT/IB2017/055104

§ 371 (c)(1),
(2) Date: Feb. 4, 2019

(87) PCT Pub. No.: WO2018/037368

PCT Pub. Date: Mar. 1, 2018

(65) Prior Publication Data

US 2019/0178201 A1 Jun. 13, 2019

(30) Foreign Application Priority Data

Aug. 24, 2016 (IT) ..... 102016000087064

(51) Int. Cl.

| | |
|---|---|
| ***F02F 1/40*** | (2006.01) |
| ***F01P 3/02*** | (2006.01) |
| ***F02F 1/42*** | (2006.01) |

(52) U.S. Cl.

CPC *F02F 1/40* (2013.01); *F01P 3/02* (2013.01); *F02F 1/4285* (2013.01); *F01P 2003/024* (2013.01)

(58) Field of Classification Search

CPC .... F02F 1/40; F02F 1/4285; F01P 3/02; F01P 2003/024

See application file for complete search history.

(56) References Cited

U.S. PATENT DOCUMENTS 3,130,461 A * 4/1964 Curtis ..... F02F 1/40 29/888.061

8,584,627 B2 11/2013 Poeschl et al.

FOREIGN PATENT DOCUMENTS

AT 501 008 A2 5/2006
CN 101 280 732 A 10/2008

(Continued)

OTHER PUBLICATIONS

Patent Cooperation Treaty, International Search Report and Written Opinion for International Application No. PCT/IB2017/055104, dated Dec. 4, 2017, 13 pages.

*Primary Examiner* — Jacob M Amick
*Assistant Examiner* — Charles Brauch
(74) *Attorney, Agent, or Firm* — Stetina Brunda Garred and Brucker

(57) ABSTRACT

An internal combustion engine comprising at least a crank case, which houses a cylinder, and a cylinder head, which is adapted to be coupled to the crank case, and a liquid cooling circuit, wherein the liquid cooling circuit comprises at least one inlet aperture and at least one outlet aperture, a lower cooling chamber housed in said cylinder head in a position adjacent to a flame deck of said cylinder head; an upper cooling chamber housed in said cylinder head above said lower chamber, so that said lower chamber is sandwiched between said upper chamber and said flame deck; wherein said inlet aperture is provided in said upper or lower chamber and said outlet aperture is provided in said lower or upper chamber, on a same side of the internal combustion engine, so that the cooling liquid runs in a substantially U-shaped path moving between said upper chamber and said lower chamber, transversely relative to a crankshaft of said engine.

17 Claims, 3 Drawing Sheets

(56) References Cited

FOREIGN PATENT DOCUMENTS

| | | | | | |
|---|---|---|---|---|---|
| CN | 103 867 332 | A | | 6/2014 | |
| FR | 2585411 | A1 | * | 1/1987 | ..... F02M 35/02483 |
| GB | 828014 | A | * | 2/1960 | ..... F02F 1/40 |
| GB | 828 014 | A | | 6/1960 | |
| GB | 2 516 647 | A | | 2/2015 | |
| WO | WO 2005/042955 | A2 | | 5/2005 | |
| WO | WO 2015/086791 | A1 | | 6/2015 | |
| WO | WO 2016/075521 | | | 5/2016 | |

* cited by examiner

INTERNAL COMBUSTION ENGINE COMPRISING A LIQUID COOLING CIRCUIT

CROSS-REFERENCE TO RELATED APPLICATIONS

The present application claims priority to PCT International Application No. PCT/IB2017/055104 filed on Aug. 24, 2017, which application claims priority to Italian Patent Application No. 102016000087064 filed Aug. 24, 2016, the entirety of the disclosures of which are expressly incorporated herein by reference.

STATEMENT RE: FEDERALLY SPONSORED RESEARCH/DEVELOPMENT

Not applicable.

TECHNICAL FIELD OF THE INVENTION

The invention relates to the field of cooling circuits for internal combustion engines.

STATE OF THE ART

The cylinder head and the cylinders of internal combustion engines must be properly cooled. The cooling circuit comprises a portion on the outside of the engine, which includes at least one radiator, and a portion on the inside of the engine, which includes one or more passageways through the thermally critical areas of the engine. The cooling liquid coming from the outer portion of the cooling circuit is usually introduced into a jacket of the cylinder and, from there, it flows towards the cylinder head of the engine, so as to cool the organs contained therein.

Assuming to have a cylinder arranged vertically, the cooling liquid moves from the bottom to the top, namely from the cooling chamber of the cylinder towards the cylinder head. Subsequently, it is collected in order to newly circulate in the outer portion of the cooling circuit.

The most critical areas are evidently located close to the so-called flame deck. Organs such as injectors and valves, especially exhaust ports, must be properly cooled.

U.S. Pat. No. 8,584,627 shows a solution in which the cylinder head is cooled by means of two chambers, namely a lower chamber, which is adjacent to the combustion chamber, and an adjacent upper chamber, which is arranged above and next to the lower chamber. Both extend perpendicularly to the development axis of the cylinder.

According to this layout, the liquid enters the cooling chamber of the cylinder and, from there, a first portion reaches the lower chamber and a second portion reaches the upper chamber. The first portion that reached the upper chamber subsequently gets into the lower chamber, thus joining the second portion.

The lower chamber houses the outlet aperture, which establishes a communication between the inner portion of the cooling circuit of the engine and the outer portion thereof.

The lower chamber of U.S. Pat. No. 8,584,627 is designed to cool the flame deck and the exhaust ports of the cylinder head, but the description and the drawings do not clarify the arrangement of the so-called bypass apertures relative to the intake and exhaust ports.

The same considerations also apply to the ducts leading into the upper chamber, which, according to the description, can be arranged on opposite longitudinal sides of the cylinder head.

WO2016075521 shows a diagram in which the inner circuit of the engine is U-shaped, wherein the inlet and the outlet are arranged on a side of the engine in such a way that the U is oriented parallel to the alignment of the different cylinders of the engine, so that the cooling liquid cools, at the first, the upper part of all the intake ports, in succession, of all the cylinders and, then, the lower part of the same ports, according to a sequence that is reverse relative to the previous succession. Therefore, the U-shaped path is contained in a plane that is parallel to a plane where the cylinder alignment axes lie.

We think that this layout can be improved. It is indeed hard to ensure that the cooling liquid actually reaches the upper chamber when the water pump reduces the cooling liquid flow rate.

SUMMARY OF THE INVENTION

The object of the invention is to improve the aforesaid cooling layout shown in U.S. Pat. No. 8,584,627 and WO2016075521.

A further object of the invention is to provide implementing details, which are absent in U.S. Pat. No. 8,584,627.

The idea on which the invention is based is that of having a cooling circuit of the cylinder head divided into two chambers, as disclosed in U.S. Pat. No. 8,584,627, namely an upper chamber and a lower chamber. The latter is adjacent to the flame deck and, therefore, is sandwiched between the upper chamber and the flame deck.

Furthermore, according to the invention, the cooling circuit of each cylinder defines a substantially U-shaped path, which is provided between said upper and lower chamber. This path is oriented perpendicularly to a plane where the axes of two or more cylinders lies, which define the internal combustion engine, or—more simply—it is oriented transversely to a crankshaft of the internal combustion engine.

Therefore, the inlet aperture is provided in the upper or lower chamber and the outlet aperture is provided in the lower or upper chamber, respectively, both on a same side of the cylinder close to an intake or exhaust port. Preferably, the inlet and the outlet are arranged on the side of the internal combustion engine where the outlet apertures are arranged, so that the cooling liquid, by flowing in said substantially U-shaped path, cools—at first—the upper part and—then—the lower part or vice versa of the cylinder head.

Therefore, the internal combustion engine has as many U-shaped circuits as the cylinders, all oriented perpendicularly to said plane, which contains the axes of all the cylinders. This plane, from now on, will be referred to as alignment plane.

According to a preferred embodiment of the invention, the cylinder head and, precisely, the upper chamber are directly supplied from the outside of the engine. From here, the liquid moves transversely to the development axis of the cylinder and perpendicularly to said alignment plane, then flows downwards, thus flooding the lower chamber of cylinder head, and finally moves back reaching the outlet aperture provided in the upper chamber of the head.

By so doing, you can ensure a continuous and adequate inflow of cooling liquid also under conditions of low flow rate of the cooling liquid pump and, at the same time, you can make sure that the head of the engine is cooled in an efficient manner.

According to a preferred embodiment of the invention, the liquid enters the lower chamber of the head, flows from an area surrounding the exhaust ducts towards an area surrounding the intake ducts and, from here, reaches the upper chamber mainly through one or more apertures adjacent to the intake ducts and—optionally and secondarily—through one or more apertures adjacent to the injector, which is arranged centrally between the inlet and outlet apertures of the head, so as to col the injector.

The cooling chamber of the cylinder is preferably supplied with cooling liquid by means of an outer aperture, which is independent of the one of the head. Alternatively, the cooling liquid enters the engine through the cooling chamber of the cylinder, then moves upwards reaching the lower chamber and, from here, the aforesaid U-shaped path is formed.

According to a preferred embodiment of the invention, the inlet aperture to let the cooling liquid into the cooling chamber of the cylinder is provided on the side of the engine where the intake ducts of said two or more cylinders are located, so that, between the path provided in the cooling chamber of the cylinder and the path provided in the head of the relative cylinder, you can obtain—as a whole—an S-shaped path, with the axis of the S coinciding with or anyway parallel to the axis of the relative cylinder, with the S lying on a plane that is perpendicular to the aforesaid alignment plane or—equally—perpendicular to the crankshaft.

The cooling chamber of the cylinder and the lower chamber of the head can be connected, if necessary, through an adjusted hole for the de-aeration of the cooling chamber of the cylinder in the area of the inlet aperture of the cooling chamber of the cylinder.

Similarly, an adjusted de-aeration hole can be arranged between the lower chamber and the upper chamber, on the same side where the outlet aperture of the circuit is arranged.

These adjusted apertures do not convey a flow rate exceeding 10-20% of all the cooling liquid; therefore, the concepts discussed above remain unchanged. The possible presence of said adjusted apertures justifies the use the term "substantially" in the expression "substantially U-shaped"

According to the invention, there is provided an internal combustion engine comprising a liquid cooling circuit according to claim 1.

According to the invention, there is further provided a method for cooling an internal combustion engine.

The claims describe preferred variants of the invention and form an integral part of the description.

BRIEF DESCRIPTION OF THE FIGURES

Further objects and advantages of the invention will be best understood upon perusal of the following detailed description of an embodiment thereof (and of relative variants) with reference to the accompanying drawings merely showing non-limiting examples, wherein.

In the figures, the same numbers and the same reference letters indicate the same elements or components.

For an easier comprehension of the invention, the same number references are used for equivalent parts of the different variants.

For the purposes of the invention, the term "second" component does not imply the presence of a "first" component. As a matter of fact, these terms are only used for greater clarity and should not be interpreted in a limiting manner.

DETAILED DESCRIPTION OF EMBODIMENTS

Figure 1:
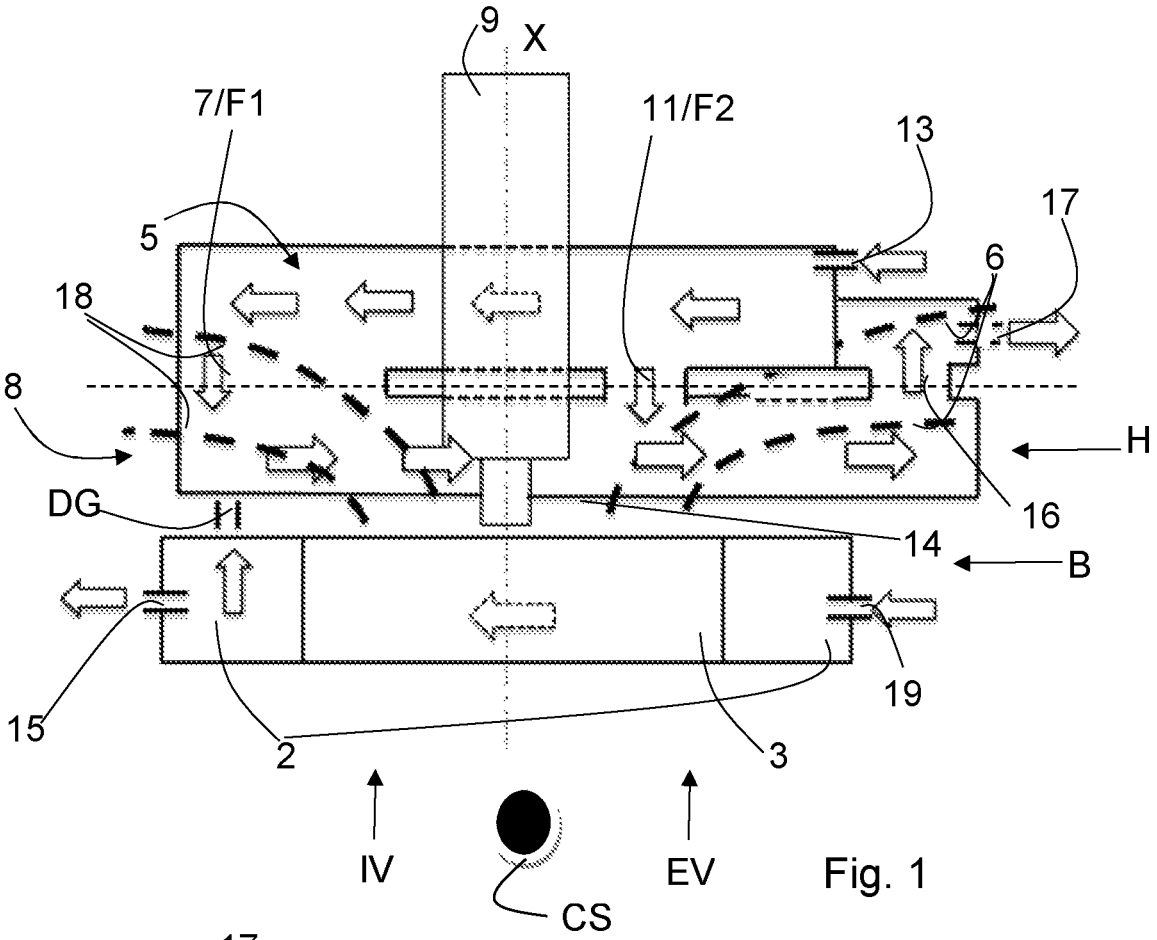
FIG. 1 schematically shows a cooling circuit according to a first preferred embodiment of the invention.

FIG. 1 schematically shows a portion of an internal combustion engine, especially the relative cooling circuit on the inside of the engine itself. The layout is shown according a longitudinal section of a cylinder, i.e. parallel to a development axis X of the cylinder 3 in a direction that is perpendicular to the crankshaft (CS) (coming out of the sheet), displayed according to a relative cross section, so that on the left side of the figure the are—ideally—the intake ports and on the right side there are the exhaust ports.

Assuming that an internal combustion engine usually comprises two or more cylinders, the plane containing the axes of said two or more cylinders is referred to as "alignment plane". The crankshaft of the internal combustion engine usually lies on said plane.

Figure 3:
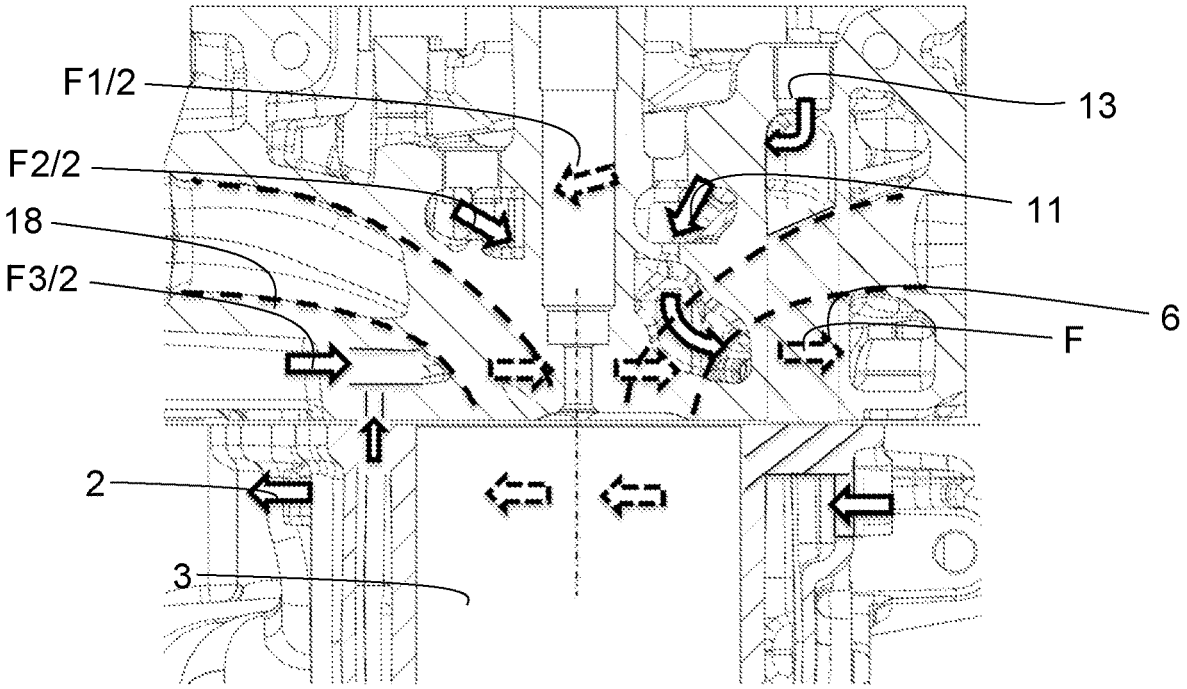
FIG. 3 shows a section of the internal combustion engine of FIG. 2 according to a symmetry axis of a cylinder of the internal combustion engine and perpendicularly to the relative crankshaft.
Figure 4:
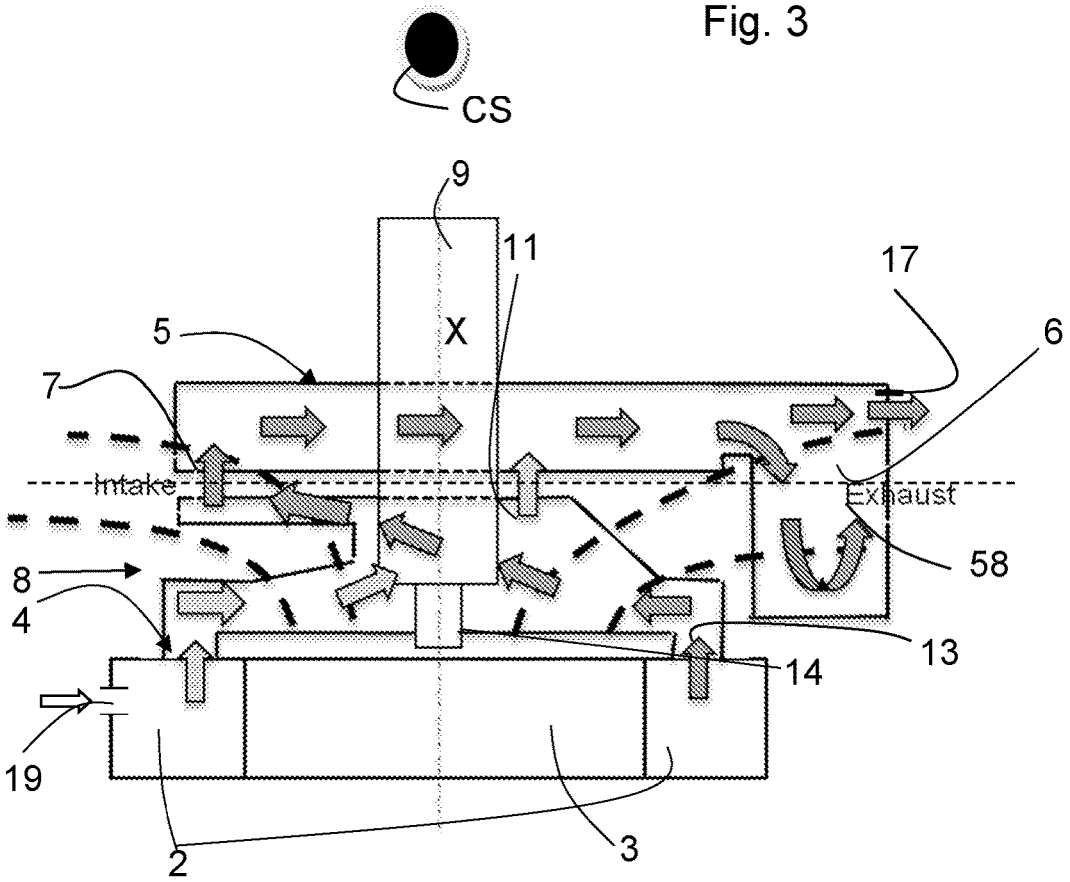
FIG. 4 schematically shows a cooling circuit according to a second preferred embodiment of the invention.

Therefore, the sections of FIGS. 1, 3 and 4 are perpendicular to the alignment plane and approximately go through a symmetry axis X of a cylinder. The intake duct 18 and the exhaust duct 6 are shown with broken lines in FIG. 1, in FIG. 3 and in FIG. 4. In the latter, they are explicitly referred to as "Intake" and "Exhaust".

The circuit comprises a cooling chamber 2 of the cylinder 3. It can be single or it can be divided into two portions. Furthermore, when the internal combustion engine comprises different cylinders, each cylinder can comprise its own individual cooling chamber, or two or more cylinders can share one cooling chamber. Furthermore, if the cooling chamber 2 is shared by different cylinders, it can be divided into portions, all hared by said different cylinders.

The cooling chamber 2 of the cylinder 3 is preferably directly connected to the "outer" portion of the cooling circuit of the engine through the aperture 19. Said outer portion comprises at least one radiator (not shown) to release heat to the outside. A pump (not shown) allows the recirculation of the cooling liquid.

According to the invention, the cooling circuit of the cylinder head, like in U.S. Pat. No. 8,584,627, is formed by two chambers, a lower chamber 8, which is adjacent to the flame deck 14, and an upper chamber 5, which is adjacent to the lower chamber and is arranged above it. In other words, the lower chamber, like a sandwich, is arranged between the flame deck 14 and the upper chamber 5.

According to the first variant of the invention, the upper chamber 5 is directly supplied by the outer portion of the cooling circuit by means of a dedicated sleeve (not shown).

Therefore, the engine preferably comprises two independent inlets: one 19 in the crank case B to supply the cooling chamber of the cylinder and one 13 in the cylinder head H to supply the upper chamber 5 of the cylinder head H.

Preferably, the inlet 13 is arranged close to the exhaust ducts, so that the liquid entering the upper chamber of the head flows from an area surrounding the exhaust ducts, transversely, towards an area surrounding the intake ducts and reaches the lower chamber primarily through the end apertures 7 arranged next to the intake ports along the side opposite the inlet aperture 13 and, marginally, through the aperture 11 adjacent to the injector 9, which is completely optional, thus allowing the liquid to cool the injector, which is arranged in an approximately central position.

Hence, this aperture extends parallel to the axis of the relative cylinder in a peripheral position relative to the intake ports IV.

The outlet aperture 17 of the cylinder head, which allows the liquid to be collected after having fulfilled its task, is located on the same side as the aperture 13, so that the cooling liquid, after having reached the lower chamber, moves in an opposite direction compared to before, namely from the intake ports to the exhaust ports, following a substantially U-shaped path. The U lies on a plane that is perpendicular to the crankshaft, with the axis of the U perpendicular to the axis of the cylinder.

Preferably, the lower chamber 8 comprises an end section 16, which extends upwards from the lower chamber to the upper chamber and surrounds the end section of the exhaust duct/s 6, so as to receive further heat from them, before the cooling liquid is released to the outer portion of the cooling circuit.

Figure 2:
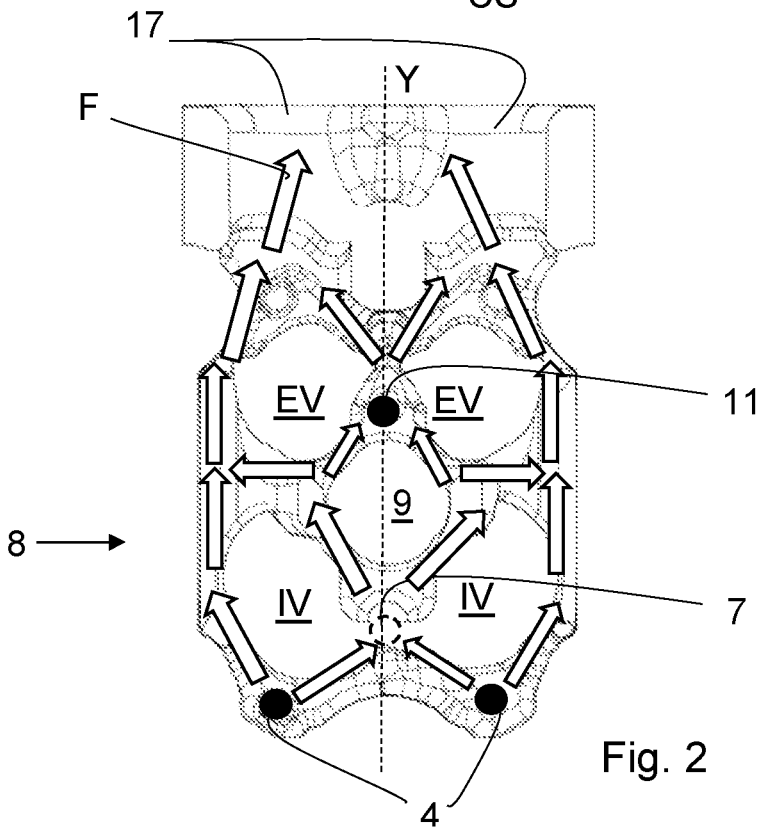
FIG. 2 shows a cross section of the lower cooling chamber of the cylinder head of an internal combustion engine according to the layout of FIG. 1.

The first variant described through FIGS. 1-3 preferably comprises exhaust ducts integrated in the cylinder head of the engine.

The cooling chamber of the cylinder 2 is preferably cooled by means of an independent liquid flow, which substantially crosses it from the exhaust ports towards the intake ports. This time, the liquid is collected on the opposite side of the crank case, on the left of the sheet, relative to the inlet 19 and, therefore, also opposite relative to the inlet 13 of the head and the outlet 17 of the head. In other words, the outlet is on the same side of the engine, corresponding to the intake ducts thereof.

FIG. 1 shows a duct DG that establishes a communication between the cooling chamber of the cylinder and the lower chamber 8. This aperture, which is preferably adjusted through the gasket of the cylinder head, is adapted to permit the de-aeration of the cooling chamber of the cylinder.

FIG. 1 schematically shows a dash-dot axis X, which represents the axis of the cylinder 3, which can be a rotation axis thereof, if the cylinder has a cylindrical symmetry, on which the injector 9 is preferably centred. Nevertheless, a cross section of the cylinder 3, namely perpendicular to the development axis of the cylinder 3, can be ellipsoid-shaped and the injector 9 can be arranged in a non perfectly centred manner.

FIG. 2 shows a section transverse to the axis X, going through the lower chamber 8. It shows the apertures relative to the cooling chamber of the cylinder and, with a broken line, the inlet aperture 7 for the liquid coming from the upper chamber.

This section is preferably symmetrical relative to the axis Y, which is perpendicular to the axis X. This means that every reference used on one side of FIG. 2 is implicitly present also on the other side thereof.

The cylinder head of the engine preferably is of the type having 4 vales, namely with two intake valves IV and two exhaust valves EV with the injector 9 substantially arranged at the centre.

According to FIG. 2, the symmetry axis Y is arranged in such a way that on each side there are an intake valve IV and an exhaust valve EV. In other words, the two exhaust valves are adjacent to one another and the two intake valves are adjacent to one another.

The position of the exhaust ports and of the injector can be slightly changed, thus turning said symmetry axis Y into a sort of separation axis between two non-symmetrical sides of the head.

The aperture 7—primarily—and the aperture 11—optionally—communicate with the upper chamber 5 above, from which the lower chamber receives the cooling liquid.

For a better comprehension of the figures, FIG. 1 also shows the flows F1, F2 flowing through the respective apertures 11 and 7.

A first larger portion of cooling liquid F1 flows from the upper chamber 5 to the lower chamber 8 through the aperture 7, which is provided between the intake valves IV and the wall of the engine opposite the one where the inlet aperture 13 is located. Therefore, this aperture 11 lies on or is close to the axis Y.

A second smaller and optional portion of cooling fluid F2 flows from the upper chamber 5 to the lower chamber 8 through the aperture 11, which is provided between the seat of the injector and the exhaust valves EV. Therefore, this aperture 11 lies on or is close to the axis Y. Evidently, the apertures 11 and 7 are provided so as to establish a communication between the chambers 8 and 5 and can be inclines, i.e. not necessarily parallel to the axis X.

Preferably, the aperture 7 and, if necessary, the aperture 11 communicate with the outside of the cylinder head through an upper surface thereof and are insulated from the outside by shuttering means. In particular, after the casting of the cylinder head, suitable holes are made and, after an inspection that allows operators to make sure that the apertures 7 and 11 are correct, the inspection holes are closed by means of threaded plugs or through welding.

A portion of cooling liquid entering from the aperture 7, shown with a broken line in FIG. 2, together with a minimum portion of liquid that can enter from the degassing apertures, continues flowing peripherally up to the outlet aperture 17. Another portion of liquid flows centrally from the aperture 7, wrapping the injector, and, by flowing further, it also reaches the outlet aperture 17. For the purpose of the description, the terms ports and valves can use indifferently, provided that the cooling of the vales is indirectly operated by cooling the relative ports.

Preferably, the first portion of liquid F1 makes up 60-70% of the total flow of liquid cooling the cylinder head. As a consequence, the second portion of liquid F2 makes up the remaining 30%-40% of the flow.

The variant of FIG. 4 is different from the previous one because the circulation of the cooling fluid takes place from the lower chamber 8 to the upper chamber 5.

Therefore, in this case, again, the cooling fluid flows along a U-shaped path in the cylinder head, with axis of the U lying on a plane perpendicular to the crankshaft and extending through the axis X of the relative cylinder, wherein the axis of the U is perpendicular to the axis X of the relative cylinder.

Like in the variant of FIG. 1, the liquid inlet is indicated with number 13, but it is arranged in the lower chamber and can communicate with the outside of the engine or, as you can see in FIG. 4, it can communicate with the cooling chamber 2 of the cylinder.

In the second case, the cooling fluid enters the engine from the single inlet 19 provided in the cooling chamber 2 and reaches the opposite side of the engine flowing upwards, until it enters the lower chamber 8 through the relative aperture(s) 13.

At this point, the liquid flows back according to a motion that goes from the exhaust duct(s) to the intake ducts(s), moves upwards through the aperture 7 to get into the upper chamber 5 and then flows back according to a motion that is reverse compared to the previous one and goes from the intake duct(s) to the exhaust ducts(s).

There can be a secondary aperture 11, which is arranged in a position opposite the aperture 7 relative to the injector 9.

Figure 5:
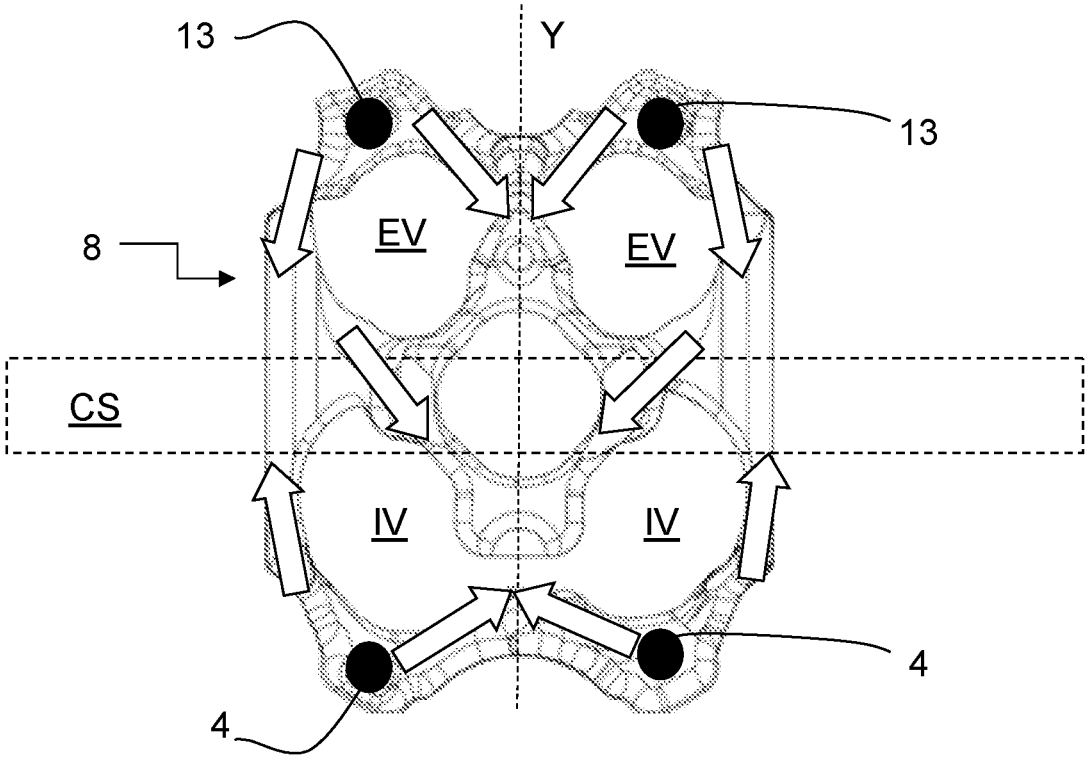
FIG. 5 shows a cross section of the lower cooling chamber of the cylinder head of an internal combustion engine according to the layout of FIG. 4.

This aperture 11 is preferably arranged between the injector and the two exhaust apertures of the cylinder, when the engine is of the type having four valves per cylinder, as you can see in FIG. 5.

The secondary aperture can fulfil a merely degassing function for the lower chamber or it can convey a secondary flow rate, which—anyway—does not exceed 20%-30% of the total flow rate.

According to a preferred aspect of the invention, again, the exhaust ducts are integrated in the cylinder head of the engine.

The upper chamber is shaped so as to wrap an outer part of the exhaust duct(s), thus creating a helical circulation that winds itself around said exhaust duct(s).

Due to this conformation, we can say that the portion 58, which is the closest to the exhaust duct(s) of the upper chamber, extends downwards in the head, approximately at the same level as the lower chamber 8, but it has an outlet aperture that is evidently located in the highest point of the upper chamber 5, so as to also allow a possible gas to flow out.

FIG. 5 shows, according to a section that is transverse to the axis X, the lower chamber of the layout of FIG. 4.

You can see the presence of a pair of apertures 13 arranged symmetrically relative to the symmetry axis Y going through the injector 9. This symmetry axis is also perpendicular to the crankshaft CS.

The fact of using a pair of apertures 13 instead of one single aperture depends on the fact that the shown solution has four valves per cylinder, but the concept on which the invention is based remains unchanged.

The apertures 4 are mainly used to carry out a de-aeration of the cooling chamber 2 of the cylinder 3. They are arranged on the opposite side of the engine relative to the inlet apertures 13 and symmetrically relative to the symmetry axis Y of the cylinder head.

The symmetry axis Y is perpendicular to the crankshaft and goes through the injector 9 and, hence, through the axis X of the relative cylinder.

Therefore, the cooling liquid led through the apertures 4 does not exceed 10-20% of the total.

Figure 6:
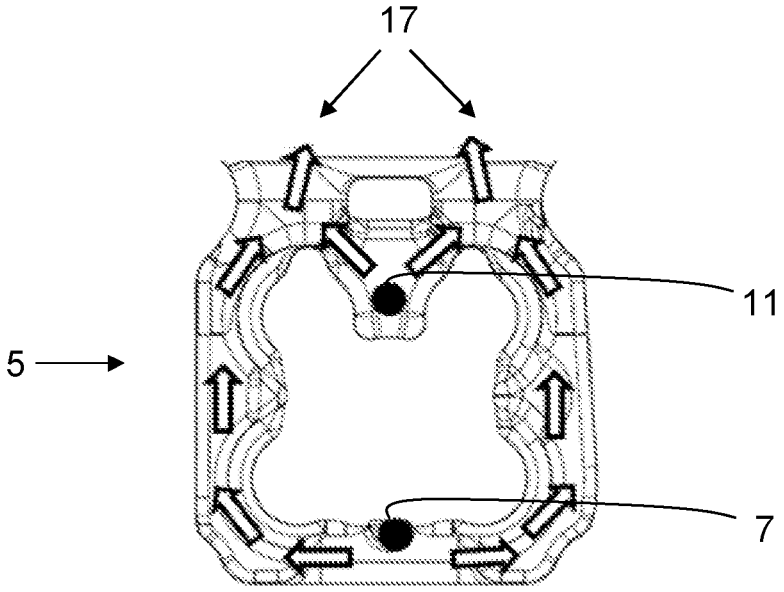
FIG. 6 shows a cross section of the upper cooling chamber of the cylinder head of an internal combustion engine according to the layout of FIG. 4.

FIG. 6 shows the upper chamber 5 of the solution of FIG. 4.

You can see the main aperture 7, through which the cooling liquid flows from the lower chamber to the upper chamber in order to, through it, flow back towards the exhaust duct(s) 6 and be collected so as to be recirculated through the outer portion of the cooling circuit of the engine.

When reading the description above, a skilled person can carry out the subject-matter of the invention without introducing further manufacturing details. If not specifically excluded by differences explicitly described herein, the information contained in the part concerning the state of art should be considered as an integral part of the detailed description.

The invention claimed is:

1. An internal combustion engine comprising
- a crankcase,
- at least one cylinder housed in the crankcase,
- a crankshaft, and
- a cylinder head, which is coupled to the crankcase and comprises
  - a) at least one exhaust port,
  - b) at least one intake port,
  - c) a flame deck, and
  - d) a liquid cooling circuit for delivery a cooling liquid;

wherein the liquid cooling circuit comprises
- at least one inlet aperture,
- at least one outlet aperture communicating with the outside of the engine,
- a lower cooling chamber housed in said cylinder head in a position adjacent to said flame deck,
- an upper cooling chamber housed in said cylinder head above said lower cooling chamber, so that said lower cooling chamber is arranged between said upper cooling chamber and said flame deck, and
- a path between said lower cooling chamber and said upper cooling chamber;

wherein the engine has a first side and a second side, opposite to each other; wherein said inlet aperture, said outlet aperture and said exhaust port are arranged at said first side; wherein said upper cooling chamber and said lower cooling chamber mutually communicate with one another, so that the cooling liquid flows along a substantially U-shaped path starting from said upper cooling chamber and ending at said lower cooling chamber, or vice versa, along a direction that is transverse to said crankshaft;

wherein said cylinder has a cylinder axis, and said cooling liquid flows:
- in a first chamber of said upper cooling chamber and lower cooling chamber, along a first direction, which is transverse relative to said cylinder axis;
- in said path through a main aperture towards a second chamber of said upper cooling chamber and lower cooling chamber, and
- in the second chamber, transversally relative to said cylinder axis and along a second direction, which is opposite said first direction.

2. The engine according to claim 1, wherein said U-shaped path joins said exhaust port to said intake port.

3. The engine according to claim 1, wherein said upper cooling chamber and said lower cooling chamber are mutually communicating through at least one main aperture along said path; said main aperture being arranged at said second side.

4. The engine according to claim 3, wherein said cylinder head further comprises an injector, arranged in an approximately central position of the cylinder head between said intake port and said exhaust port, and wherein said upper cooling chamber and said lower cooling chamber further communicate with each other through a secondary aperture, which is arranged between said exhaust port and said injector.

5. The engine according to claim 3, wherein said main aperture is arranged alongside said intake port.

6. The engine according to claim 3, wherein said main aperture communicates with an area outside of the cylinder head through an upper surface of the cylinder head and is insulated from said area by a shutter device.

7. The engine according to claim 1, wherein said crankcase comprises a cylinder cooling chamber for cooling the cylinder, the cylinder cooling chamber having a further inlet aperture arranged at said first side and a further outlet aperture arranged at said second side.

8. The engine according to claim 7, wherein said further outlet aperture communicates with the outside of the internal combustion engine.

9. The engine according to claim 7 and further comprising an aperture between said cylinder cooling chamber and said lower cooling chamber, so as to permit de-aeration of the cylinder cooling chamber.

10. The engine according to claim 1, wherein said cylinder head further comprises an exhaust duct comprising an end portion; and wherein said lower cooling chamber comprises an upwardly projecting portion which surrounds said end portion.

11. The engine according to claim 1, wherein said inlet aperture is arranged at said lower cooling chamber, and said outlet aperture is arranged at said upper cooling chamber.

12. The engine according to claim 11, wherein said crankcase comprises a cylinder cooling chamber for cooling the cylinder, and wherein said inlet aperture communicates, inside the engine, with said cylinder cooling chamber.

13. The engine according to claim 12, wherein said cylinder cooling chamber comprises a further aperture communicating with the outside of the engine and arranged at said second side.

14. The engine according to claim 1, wherein said cylinder head further comprises an exhaust duct, and wherein said upper cooling chamber is close to said outlet aperture, projects towards said lower cooling chamber so as to surround said exhaust duct, and is shaped so as to cause a helical flow of the cooling liquid around said exhaust duct.

15. The engine according to claim 1, wherein said cylinder head further comprises a pair of intake valves adjacent to one another, a pair of exhaust valves adjacent to one another, an injector arranged centrally between said intake valves and said exhaust valves, and wherein said upper cooling chamber and said lower cooling chamber are mutually communicating through a main aperture, which is arranged between said intake valves and said second side.

16. The engine according to claim 15, wherein said cylinder has a cylinder axis, and wherein said intake valves and said exhaust valves are arranged symmetrically relative to a symmetry axis, which is perpendicular to said cylinder axis, and wherein said inlet aperture is divided into two apertures, arranged symmetrically to one another relative to said symmetry axis.

17. The engine according to claim 16, wherein said crankcase comprises a cylinder cooling chamber for cooling the cylinder, and wherein said cylinder cooling chamber comprises a pair of de-aeration apertures, which are arranged at said second side and are mutually symmetrical relative to said symmetry axis.

* * * * *